US007549417B2

(12) United States Patent
Dang

(10) Patent No.: US 7,549,417 B2
(45) Date of Patent: Jun. 23, 2009

(54) QUICK INSTALL/REMOVE STOVE GUARD

(75) Inventor: Qi Dang, 32964 Soquel St., Union City, CA (US) 94587

(73) Assignee: Qi Dang, Union City, CA (US)

( * ) Notice: Subject to any disclaimer, the term of this patent is extended or adjusted under 35 U.S.C. 154(b) by 410 days.

(21) Appl. No.: 11/636,853

(22) Filed: Dec. 11, 2006

(65) Prior Publication Data

US 2008/0135036 A1 Jun. 12, 2008

(51) Int. Cl.
*F24C 3/12* (2006.01)
*F24C 15/12* (2006.01)

(52) U.S. Cl. ..... 126/42; 126/214 D; 126/201

(58) Field of Classification Search ..... 126/42, 126/211, 214 D
See application file for complete search history.

(56) References Cited

U.S. PATENT DOCUMENTS 4,157,705 A 6/1979 Caan
4,517,955 A 5/1985 Ehrlich
4,836,181 A 6/1989 Saga
5,117,807 A * 6/1992 Graulich ..... 126/190
5,546,928 A 8/1996 Lewis
5,664,554 A * 9/1997 Martin ..... 126/201
5,758,636 A 6/1998 Butrimas
5,842,464 A 12/1998 Koch

* cited by examiner

*Primary Examiner*—Steven B McAllister
*Assistant Examiner*—Sarah Suereth

(57) ABSTRACT

A stove (or range) burner guard attached to the front of a gas or electrical stove (or range) by inserting the lower portion of the guard between the oven door handle and the oven door. The guard is secured by two identical holding devices, which are attached to the surface of the oven door. The guard prevents young children from reaching the burners, control knobs and cookware on the stovetop. The guard can be installed or removed in seconds.

1 Claim, 5 Drawing Sheets

QUICK INSTALL/REMOVE STOVE GUARD

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

1. Field of invention

The invention is related to a quick install/remove stove burner guard, which prevents small children from reaching the burners, control knobs and cookware on the stovetop. The guard also prevents small children from coming in contact with heated liquid or other foods that may bubble or splash from cookware on the stovetop. The guard panel can be installed or removed in seconds.

2. Description of the Prior Art

A number of stove guards were invented in the prior art to prevent small children from reaching the stove burners, control knobs and cookware while cooking as listed on the following list:

| | | |
|---|---|---|
| 4157705 | June 1979 | Caan |
| 4517955 | May 1985 | Ehrlich et al. |
| 4836181 | June 1989 | Saga |
| 5546928 | August 1996 | Lewis et al. |
| 5758636 | June 1998 | Butrimas et al. |
| 5842464 | December 1998 | Koch |

Those devices described in the prior art often require complicated installation procedures. Once installed, the devices are difficult to remove for cleaning. In some cases, the guard panels are attached to the top of the stove surface, making the guard panel vulnerable to heat damage.

The complicated installing and removing devices make those guards less likely to be used on a regular basis when small children are present, and this departs from the purpose of the inventions. Therefore, new and improved stove guards are needed to overcome the disadvantages of the existing inventions. The current invention addresses this need.

SUMMARY OF THE INVENTION

The objective of this invention is to provide a reliable, and simple way to install a stove guard to prevent small children from reaching the stove burners, control knobs and cookware while cooking. The present invention provides a stove guard that requires no permanent mounting device, and can be installed or removed in seconds, which increases the likelihood that parents and other caregivers of small children will use it more frequently. The guard panel is inserted between the oven door handle and the oven door, and secured by two identical holding devices attached to the surface of the oven door.

The guard panel is not attached to the top surface of the stove where the burners are located, thus minimizing the chance that heat damage to the guard panel will occur during use. The upper portion of the stove guard is bent 20 degrees outward to provide more rooms for cookware handles and utensils.

BRIEF DESCRIPTION OF THE DRAWINGS FIGURES

DESCRIPTION OF THE PREFERRED EMBODIMENTS

Figure 1:
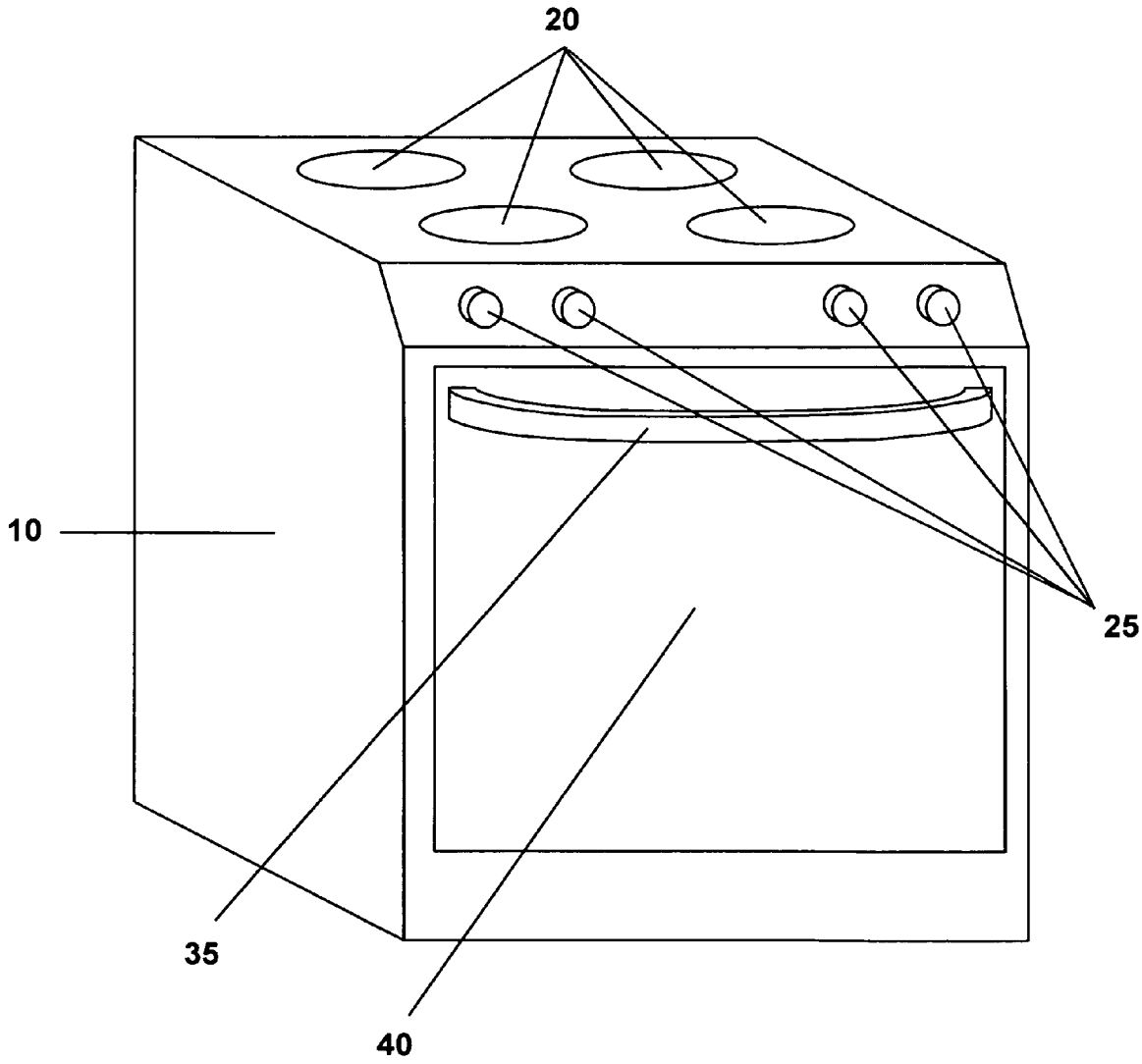
FIG. 1 is a view of stove/range with burners on the top and an oven with the door handle located beneath the burners. Control knobs are located in the upper front of the range.

The invention provides a new and improved design of the stove guard. For the purposes of promoting an understanding of the principles of the invention, reference will now be made to the embodiments illustrated in the drawings referring to FIGS. 1 to 7.

FIG. 1 is a view of a typical range 10. Burners 20 are located on the top of the range 10. Control knobs 25 are located in the upper front of the range. The oven is located beneath the burner top. A hinged oven door 40 is located in the front of the oven. An elongated C-shaped oven door handle 35 is attached to the upper portion of the oven door.

Figure 2:
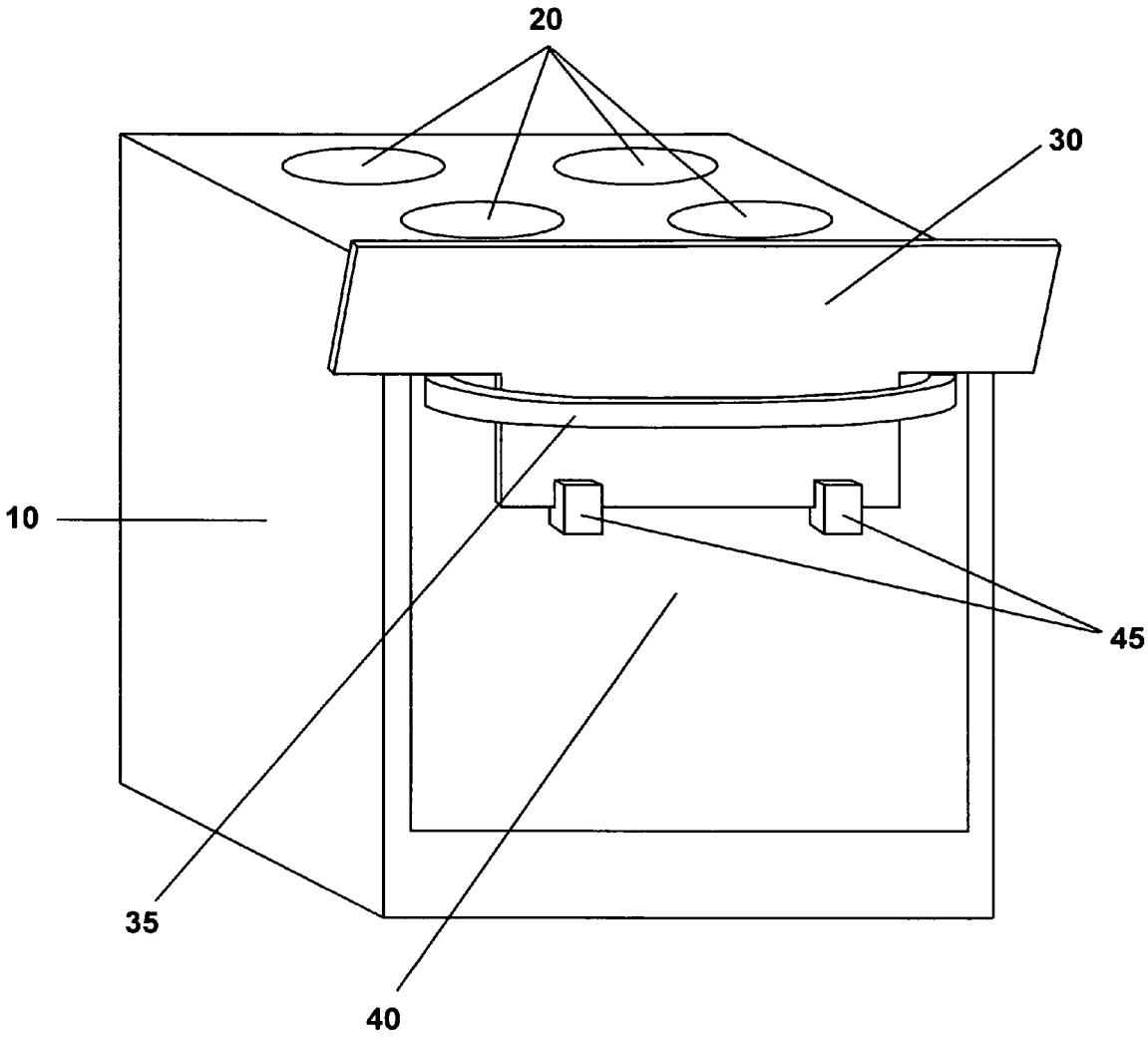
FIG. 2 is the perspective view of the range with the stove guard inserted in a secured position.

FIG. 2 is the perspective view of the range with the stove guard panel 30 inserted and secured into position by holding devices 45. The width of the lower portion of the guard panel is reduced and inserted between the oven door handle 35 and the oven door. The bottom edge of the guard panel is secured by inserting the bottom edge into the deep groove 47 on the upper portion of each holding device 45.

Figure 3:
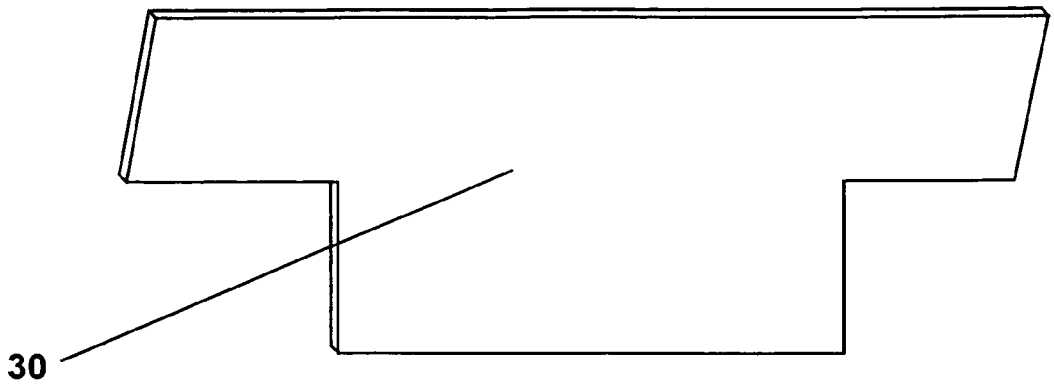
FIG. 3 is the front view of the guard panel. The width of the lower portion of the panel is reduced.

FIG. 3 is the front view of the guard panel 30. The width of the lower portion of the panel 30 is reduced in order to be able to insert between the oven door handle 35 and oven door 40.

Figure 4:
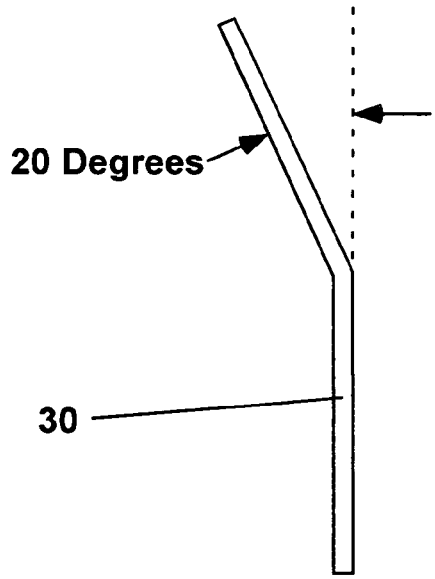
FIG. 4 is the side view of the guard panel. The upper portion of the panel is bent 20 degrees outward.

FIG. 4 is the side view of the guard panel 30. The upper portion of the panel 30 is bent 20 degrees outward to provide extra space for cookware handles and reduce the chance that the guard panel be damaged by heat.

Figure 5:
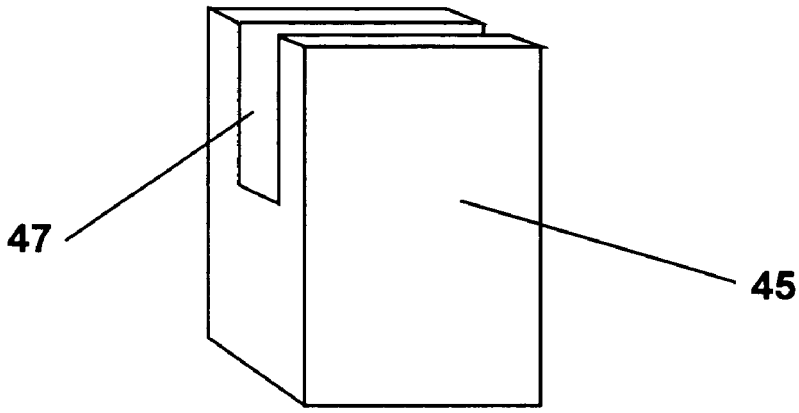
FIG. 5 is the view of one of the two identical holding devices.

FIG. 5 is the view of one of the two identical holding devices 45. Each device 45 is a rectangular block with a deep groove 47 cut on the upper portion of the device. The width of the groove 47 is slightly greater than the thickness of the guard panel 30.

Figure 6:
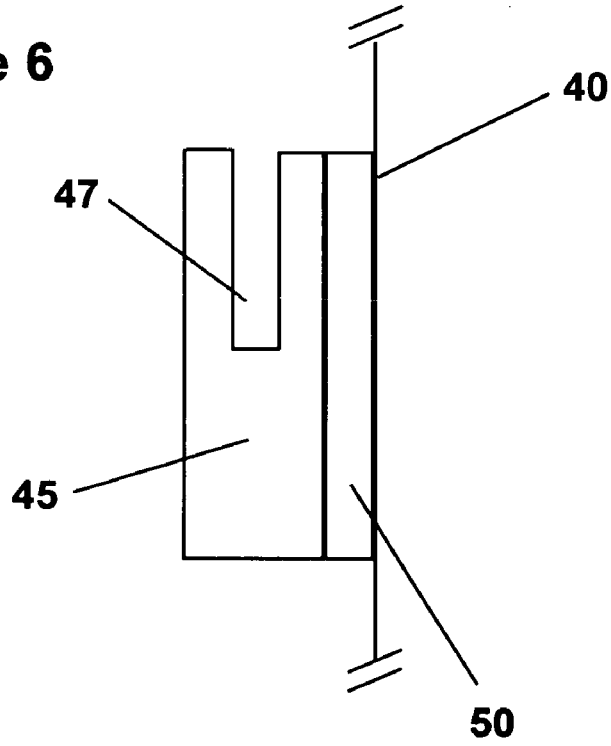
FIG. 6 is the cross section view of one of the two identical holding devices, which are attached by double-faced taped to the outer surface of the oven door. Each holding device is made of a rectangular block with a deep groove cut on the upper portion of the block.

FIG. 6 is the cross section view of one of the two identical holding devices 45 when it is attached to the surface of the oven door 40 by double-faced tape 50.

Figure 7:
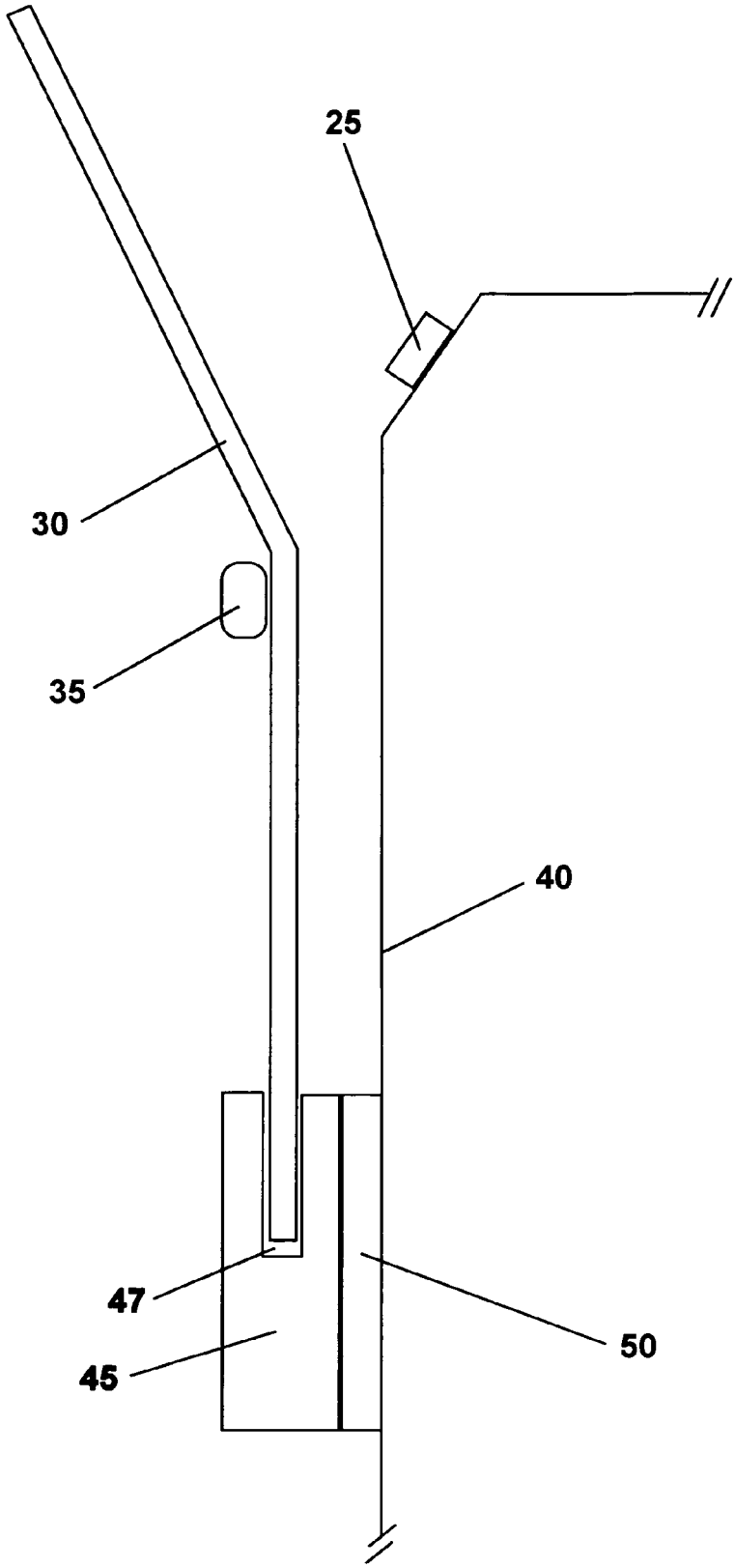
FIG. 7 is the cross section view of the installed guard panel. The bottom edge of the guard panel is inserted into the groove cut into the upper portion of each holding device.

FIG. 7 is the cross section view of the installed guard panel, showing one of the two identical holding devices 45 with the guard panel 30 inserted into the groove 47 on the upper portion of the holding device 45. When the bottom edge of the guard panel 30 is inserted into the two identical holding devices 45, the guard panel 30 is secured, and cannot be rocked back and forth.

The guard panel 30 and holding devices 45 can be made of plastic, aluminum, other metals or other durable materials.

What is claimed is:

1. A stove guard assembly comprising: a guard panel mounted on an oven door of a stove, said guard panel including an upper rectangular portion and a lower rectangular portion, said upper rectangular portion having a width greater than a width of the stove, said upper rectangular portion having a bottom edge resting on a handle of said oven door, said upper rectangular portion being inclined at a twenty degree angle from the plane of the lower rectangular portion; said lower rectangular portion having a width less than the width of said upper rectangular portion; said lower rectangular portion inserted between the oven door handle and the oven door; further comprising two U-shaped holding devices mounted on a front surface of said oven door, said holding devices receiving a bottom edge of said lower rectangular portion.

* * * * *